US011827441B2

(12) United States Patent
Yagi

(10) Patent No.: US 11,827,441 B2
(45) Date of Patent: Nov. 28, 2023

(54) INSULATED BAG AND FOLDABLE INSULATED BAG

(71) Applicant: GLOBERIDE, Inc., Tokyo (JP)

(72) Inventor: Hiroshi Yagi, Tokyo (JP)

(73) Assignee: GLOBERIDE, INC., Tokyo (JP)

( * ) Notice: Subject to any disclaimer, the term of this patent is extended or adjusted under 35 U.S.C. 154(b) by 0 days.

(21) Appl. No.: 17/194,529

(22) Filed: Mar. 8, 2021

(65) Prior Publication Data

US 2021/0387790 A1 Dec. 16, 2021

(30) Foreign Application Priority Data

Jun. 11, 2020 (JP) ..... 2020-101890
Jun. 11, 2020 (JP) ..... 2020-101891

(51) Int. Cl.
*B65D 81/38* (2006.01)
*A45F 3/02* (2006.01)
*B65D 33/24* (2006.01)

(52) U.S. Cl.
CPC ..... *B65D 81/3897* (2013.01); *A45F 3/02* (2013.01); *B65D 33/24* (2013.01)

(58) Field of Classification Search
CPC ..... B65D 81/3897; B65D 33/24; A45F 3/02; F25D 2323/061
USPC ..... 383/110
See application file for complete search history.

(56) References Cited

U.S. PATENT DOCUMENTS 3,344,973 A * 10/1967 Studen ..... B65D 5/563 428/116
8,919,082 B1 12/2014 Cataldo
2004/0154951 A1* 8/2004 Hartung ..... B65D 81/3823 206/521
2013/0140317 A1* 6/2013 Roskoss ..... B65B 55/00 53/410
2016/0075471 A1 3/2016 Ranade et al.
2016/0145029 A1 5/2016 Ranade et al.
2018/0194532 A1 7/2018 Ranade et al.
2018/0290815 A1 10/2018 Waltermire et al.

FOREIGN PATENT DOCUMENTS

AU 2018260901 A1 5/2020
CN 2603787 Y 2/2004
CN 108602606 A 9/2018
CN 111153052 A * 5/2020
JP S53140962 U 11/1978
(Continued)

OTHER PUBLICATIONS

Machine translation of JP-2000130924-A.*
(Continued)

*Primary Examiner* — Jes F Pascua
(74) *Attorney, Agent, or Firm* — Oliff PLC

(57) ABSTRACT

A foldable insulated bag includes: a bag main body including a bottom surface portion and a side surface portion; a lid body attached to the bag main body; and a bottom surface insulating member and a side surface insulating member provided to the bag main body, wherein the side surface insulating member has an end portion, closer to the bottom surface insulating member, provided with a fold back portion that is configured to be provided to cover at least a part of the bottom surface insulating member during use of the insulated bag.

16 Claims, 9 Drawing Sheets

(56) References Cited

FOREIGN PATENT DOCUMENTS

| | | | | | |
|---|---|---|---|---|---|
| JP | S59-141072 | | | 9/1984 | |
| JP | 01047619 | U | | 3/1989 | |
| JP | H6-024478 | | | 4/1994 | |
| JP | H09165073 | A | | 6/1997 | |
| JP | 2000130924 | A | * | 5/2000 | |
| JP | 2003-182777 | | | 7/2003 | |
| JP | 2004175368 | A | * | 6/2004 | |
| JP | 2006123914 | A | | 5/2006 | |
| JP | 3122643 | U | * | 6/2006 | |
| JP | 2009113822 | A | * | 5/2009 | |
| JP | 2010208644 | A | * | 9/2010 | |
| KR | 20100058235 | A | * | 6/2010 | |
| WO | WO-2017007197 | A1 | * | 1/2017 | ..... B65D 81/1275 |

OTHER PUBLICATIONS

GOOGLE translation of JP01047619.*

Extended European Search Report for related European Application No. 21161078.7; action dated Jan. 11, 2022; (9 pages).

Taiwanese Office Action in connection with Taiwanese Patent Application No. 110109152; action dated Aug. 17, 2021; (13 pages).

Extended European Search Report for related European Application No. 21212408.5; action dated Feb. 9, 2022; (8 pages).

Chinese Office Action for related Chinese Application No. 202110244202.0; action dated Oct. 14, 2022; (24 pages).

Office Action for related Korean Application No. 10-2021-0027853; action dated Oct. 12, 2022; (15 pages).

Second Office Action in connection with Chinese Patent Application No. 202110244202.0; action dated Feb. 11, 2023; (22 pages).

Final Rejection in connection with related Korean Patent Application No. 10-2021-0027853; action dated Feb. 3, 2023;(8 pages).

Office Action in connection with Japanese Patent Application No. 2020-101890; action dated Jul. 11, 2023; (10 pages).

Office Action in connection with Japanese Patent Application No. 2020-101891; action dated Jul. 11, 2023; (10 pages).

* cited by examiner

INSULATED BAG AND FOLDABLE INSULATED BAG

TECHNICAL FIELD

This disclosure relates to an insulated bag for conveying an article while keeping it cold or warm, and a foldable insulated bag mainly used for outdoor activities such as fishing and hiking.

BACKGROUND

Various foldable insulated containers are known. An example of such a known insulated container includes a structure provided with heat insulating materials on the inner side, and can be folded together with the heat insulating materials on side and bottom surfaces.

JP-U-Sho 59-141072 discloses an example of such an insulated container. JP-U-Sho 59-141072 discloses a foldable insulated container formed as a substantially rectangular parallelepiped container having outer walls formed by soft bag bodies. The container has a lid openable relative to the main body. Rigid plate-shaped heat insulating materials are inserted into the bag bodies forming the respective outer walls of the container. A part of the heat insulating materials can be taken out from the bag body.

Conventionally, an insulated box has heat insulating materials laid on an outer box having a box shape, for conveying food, medicine and the like while keeping them cool or warm. An example of such an insulated box employs a structure in which left, right, front, and rear insulating inner wall materials, an insulating inner bottom material, and an insulating lid material are provided on the inner side of the outer box.

JP-U-Hei 6-24478 discloses an example of such an insulated box. JP-U-Hei 6-24478 discloses a fishing cooler having a heat insulating material provided between an outer case and an inner case forming a cooler main body. The heat insulating material uses, as a material, a base material obtained by immersing a foaming agent in a copolymer including vinylidene chloride as a main component.

JP-A-2003-182777 discloses an insulated box comprising: an outer box having an opening in an upper surface, the outer box being formed in a shape of a box defined by side walls and a bottom wall; plate-shaped insulating inner wall materials arranged adjacent to the side walls; a plate-shaped insulating inner bottom material placed on the bottom wall; and a plate-shaped insulating lid material that closes the opening. The insulated box comprises an edge member including: a joining piece that faces and is joined to the side walls; an upper surface portion extending inward from upper ends of the joining pieces to form a flat surface in contact with the lid material; and a hook piece bent downward from the upper surface portion. The edge member is joined and fixed to the side walls to make the upper surface portion have a substantially uniform height along an inner circumference of the upper side of the side walls. The insulating inner wall material is joined and fixed to the side walls, with an upper end surface of the insulating inner wall material fit in a rectangular U-shaped space defined by the joining pieces and the hook piece, and the insulating lid material is placed on the upper surface portion to close to opening.

Unfortunately, the foldable insulated container according to the mode disclosed in JP-U-Sho 59-141072 may not be easily foldable because the heat insulating material in the bag body corresponding to each surface needs to be taken out when the insulated container is folded. Furthermore, the structure is plagued by a gap formed between the heat insulating materials for the respective surfaces, resulting in a largely compromised cooling effect.

With the structure of the insulated bag according to the mode disclosed in any of JP-U-Hei 6-24478 and JP-A-2003-182777, the cold air inside leaks through gaps between the insulating members for the respective surfaces, even when the insulating members are in close contact with each other, meaning that cooling effect is difficulty to reliably maintain. In view of this, the insulating members for the respective surfaces may be integrally formed to improve the cooling effect. However, the integrated forming requires cost and labor. Furthermore, when the integrally formed insulating member is removed, it has to be always removed entirely.

It could therefore be helpful to provide an insulated bag to be easily folded, while improving the cooling effect, and insulating members for respective surfaces to be formed more easily and at a lower cost, and to reliably reduce the leakage of cold air between the insulating members for the respective surfaces to improve the cooling effect.

SUMMARY

I thus provide:

A foldable insulated bag may include: a bag main body including a bottom surface portion and a side surface portion; a lid body attached to the bag main body; and a bottom surface insulating member and a side surface insulating member provided to the bag main body, wherein the side surface insulating member has an end portion, closer to the bottom surface insulating member, provided with a fold back portion that is configured to be provided to cover at least a part of the bottom surface insulating member during use of the insulated bag.

The fold back portion may be configured to be provided to cover an end portion of the bottom surface insulating member.

The fold back portion may be configured to have a length of 5 mm to 170 mm.

The fold back portion may be formed over entire circumference of the side surface insulating member.

The fold back portion may be notched at boundary regions among a first side surface insulating member, a second side surface insulating member, and a third side surface insulating member adjacent to each other.

The fold back portion may cover 5% to 100% of a surface area of the bottom surface insulating member.

The fold back portion may cover the bottom surface insulating member.

An insulated bag may include: a bag main body including a bottom surface portion and a side surface portion; a lid body attached to the bag main body; a bottom surface insulating member and a side surface insulating member provided to the bag main body; and one or both of an extending portion extending in a vertical direction from the side surface insulating member and a step portion formed in the bottom surface insulating member for increasing a contact area between the side surface insulating member and the bottom surface insulating member during use of the insulated bag.

The extending portion may cover an end portion of the bottom surface insulating member.

The extending portion may have a length of 5 mm to 170 mm.

The extending portion may be configured to be formed over entire circumference of the side surface insulating member.

The extending portion may be notched at boundary regions among a first side surface insulating member, a second side surface insulating member, and a third side surface insulating member adjacent to each other.

The extending portion may cover 5% to 100% of a surface area of the bottom surface insulating member.

The extending portion may cover the bottom surface insulating member.

When the extending portion and the step portion are provided, the step portion may have a side surface in contact with a side portion of the extending portion.

When the extending portion and the step portion are provided, the step portion may be in contact with an upper portion of the extending portion and a side portion of the side surface insulating member.

The step portion may have a side surface in contact with a side portion of the side surface portion insulating member.

With my foldable insulated bag described above, the insulated bag can be easily folded and the leakage of cold air between insulating members for respective surfaces is reliably reduced, whereby the cooling effect can be improved. The insulating members for the respective surfaces can be formed more easily and at a lower cost, and the leakage of the cold air between the insulating members for the respective surfaces is reliably reduced, whereby the cooling effect can be improved.

REFERENCE SIGNS LIST

Figure 1:
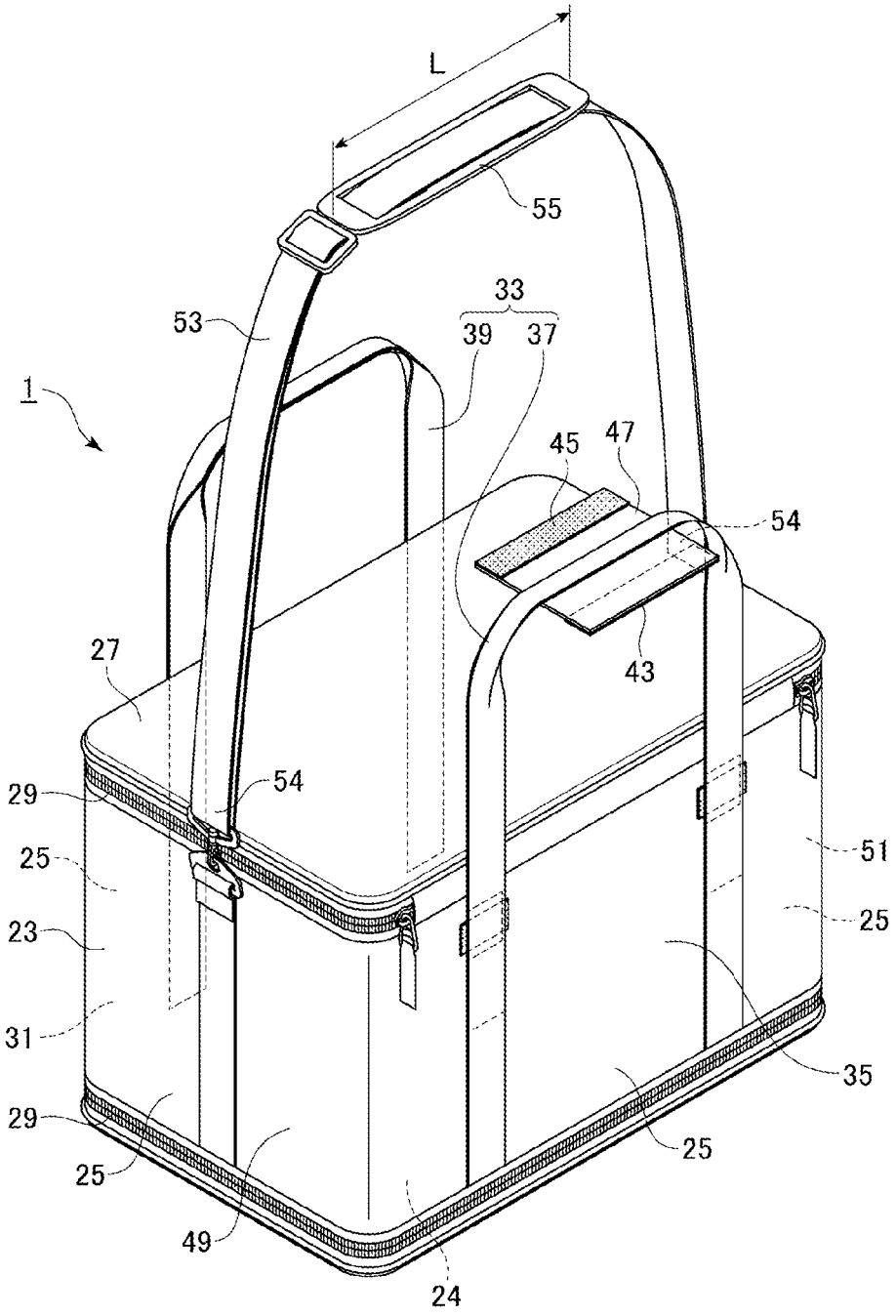
FIG. 1 is a diagram illustrating a foldable insulated bag according to an example.

1 foldable insulated bag
10 insulated bag
19 first side surface insulating member
20 second side surface insulating member
21 third side surface insulating member
22 fourth side surface insulating member
23 bag main body
24 bottom surface portion
25 side surface portion
26 bottom surface insulating member
27 lid body
28 side surface insulating member
28*a* side portion
29 fastener portion
30 extending portion
30*a* side portion
30*b* upper portion
31 front surface side surface
32 step portion
32*a* side portion
33 handle
34 end portion of bottom surface insulating member
35 rear surface side surface
37, 39 U-shaped handle
41 fold back portion
43, 45 hook-and-loop fastener
47 handle bundling loop-shaped grip
53 shoulder belt
54 both end portions
55 shoulder pad

DETAILED DESCRIPTION

Examples of my insulated bags will be described in detail with reference to the attached drawings. Elements common to a plurality of figures are denoted by the same reference numerals through the plurality of figures. For the sake of description, the figures are not necessarily drawn to scale.

Figure 2:
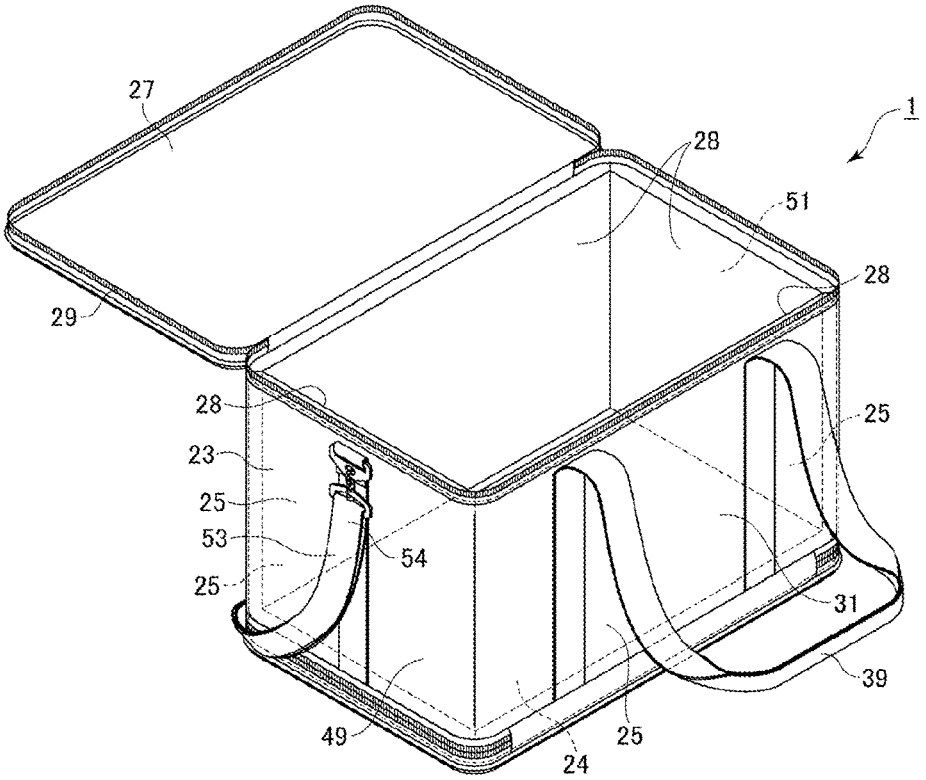
FIG. 2 is a diagram illustrating the foldable insulated bag according to an example.

One example of my foldable insulated bag will be described with reference to FIGS. 1 and 2. As illustrated in the figures, the foldable insulated bag includes a waterproof bag main body 23 having a waterproof cloth (obtained by coating a nylon or polyester woven cloth with PVC/PU/EVA) provided on the outer side, a nylon or polyester cloth provided on the inner side, and a synthetic resin foaming material such as PE or Styrofoam provided in between (the waterproof cloth surface may alternatively be used on a reverse side). The foldable insulated bag is formed to be in a shape of a box having a bottom surface and side surfaces, with an internal portion serving as a storage portion, and with a storage port opened in an upper portion. As described later, insulating members accommodating heat insulating materials are provided for respective inner surfaces of the bag main body 23 to be side surface insulating members and a bottom surface insulating member. Attachment of the heat insulating materials to the respective surface of the bag main body 23 may be implemented in various possible ways, and thus is not limited to a particular mode.

A fastener portion surrounding the outer circumference of the bottom surface of the bag main body 23 extends along the outer circumference. The bottom surface of the bag main body 23 is coupled via a hinge member (not illustrated) made of a synthetic resin sheet (such as a nylon or polyester woven cloth, for example). The bottom surface can be opened closed by being pivoted with respect to the bag main body 23 about the hinge member. The bottom surface is configured to be arrangeable to be adjacent to a side portion of the outer surface of the bag main body 23 when the insulated bag 1 is folded. Similarly, a lid body 27 described later is also configured to be arrangeable to be adjacent to a side portion of the outer surface of the bag main body 23, when the insulated bag 1 is folded. The bag main body 23 is formed by a soft material to be foldable together with the insulating members.

The lid body 27 formed of the same material as the bag main body 23 is coupled to one side (a rear surface side surface 35 described later) via a hinge member (not illustrated) made of a synthetic resin sheet. The lid body 27 has a circumference edge portion provided with a fastener portion 29 that surrounds an upper portion outer circumference of the bag main body 23 when the storage port is covered by the lid body 27 (when the storage port is closed by the lid body 27). The fastener portion 29 extends along the outer circumference. The inner surface of the lid body 27 is provided with the insulating member accommodating the heat insulating material as an upper surface insulating member. The attachment of the heat insulating material to the lid body 27 may be implemented in various possible ways, and thus is not limited to a particular mode.

The insulated bag 1 may include a handle 33 including a pair of both end portions attached to the bag main body 23. The handle 33 is attached to upper portion outer circumferences of a front surface side surface 31 and the rear surface side surface 35 of the bag main body 23 as illustrated in FIGS. 1 and 2, for example. However, this should not be construed in a limiting sense. In the illustrated example, the handle 33 includes a pair of U shaped handles 37 and 39. For example, center portions of the U-shaped handles 37 and 39 as the handle 33 may be capable of being bundled by a handle bundling loop-shaped grip 47 on which hook-and-loop fasteners 43 and 45 are sewed, to be held by a hand of a person carrying the insulated bag 1.

The insulated bag 1 may further include a shoulder belt 53 both end portions of which are attached to the bag main body 23. In this configuration, the shoulder belt 53 may be formed as a single thin belt-shaped shoulder belt 53 that is made of woven cloth or synthetic resin (molded product), fabric, leather, or the like and is spun between left and right side surfaces 49 and 51 of the bag main body 23 as illustrated in FIGS. 1 and 2. The shoulder belt 53 may have both end portions 54 sewed and fixed to the left and right side surfaces 49 and 51.

The shoulder belt 53 of the insulated bag 1 has a length long enough for the center portion, in the longitudinal direction, to touch the ground when the shoulder belt 53 hangs down from the insulated bag 1 placed on the ground. A plate-shaped shoulder pad 55 having a dimension (length L) that is substantially ⅓ of the entire length of the shoulder belt 53 is attached to the center portion of the shoulder belt 53. Further details will be omitted.

Figure 3:
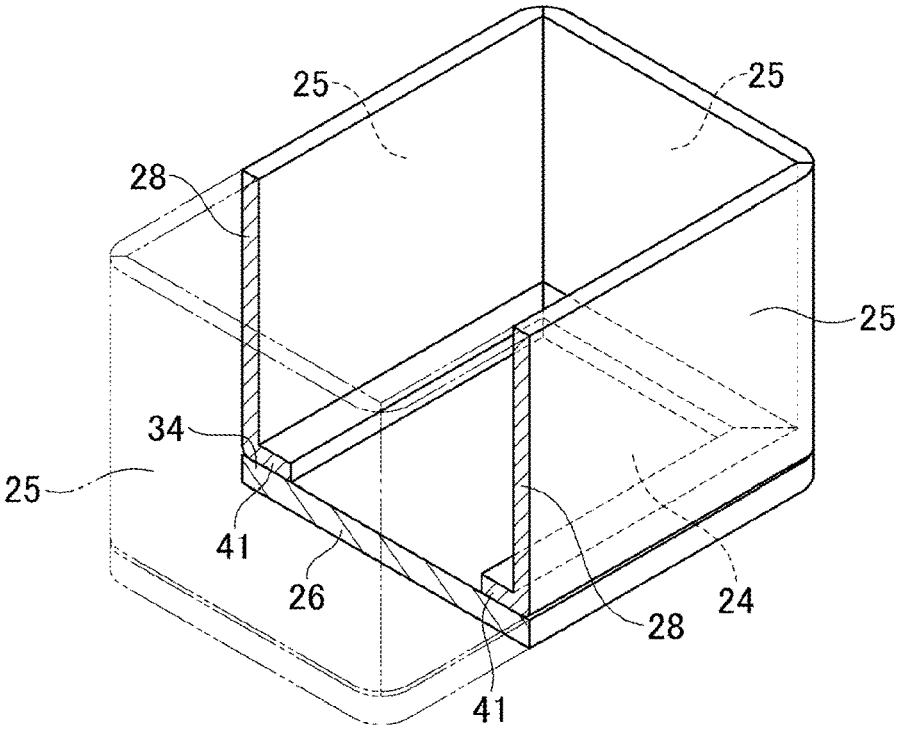
FIG. 3 is a diagram illustrating an insulating member of the foldable insulated bag according to an example.

Next, the foldable insulated bag 1 will be described more in detail with reference to FIGS. 2 and 3. As illustrated in FIGS. 2 and 3, the foldable insulated bag 1 according to an example includes: the bag main body 23 including a bottom surface portion 24 and side surface portions 25; the lid body 27 attached to the bag main body 23; and the bottom surface insulating member 26 and the side surface insulating member 28 provided to the bag main body 23. The foldable insulated bag 1 is configured to include a fold back portion 41 extending from the side surface insulating member 28 to increase a contact area between the side surface insulating member 28 and the bottom surface insulating member 26 during the use of the insulated bag. The fold back portion 41 illustrated in FIG. 3 is formed integrally with the side surface insulating member 28 to be in a substantially plate shape. The fold back portion 41 comes into contact with the bottom surface insulating member 26 upon being appropriately bent. With this configuration, when the insulated bag 1 is folded, the fold back portion 41 can be approximately parallel to the side surface insulating member 28 so that the insulated bag folded would not have the thickness unnecessarily increased.

The fold back portion is thus provided so that the insulated bag can be easily folded, and the leakage of the cold air between the insulating members for the respective surfaces can be reliably reduced so that the cooling effect can be reliably improved.

It has been known that the cooling effect of the insulated bag depends on two factors: a thermal effect from the ground on which the insulated bag is placed; and leakage of the cold air from the internal of the insulated bag (leakage of the cold air from a portion around the bottom portion in particular). To reduce the impact of the former factor, the bottom portion insulating member may be made thick, but this approach is limited by restrictions in terms of weight and dimensions. On the other hand, regarding the latter, I found that effective prevention of the leakage of the cold air between the bottom surface insulating member and the side surface insulating member individually formed is important, and I found a specific measure to achieve this. The side surface insulating member 28 may be formed by forming a single plate-shaped insulating member, bending the insulating member, and appropriately coupling/bonding both end portions of the insulating member.

As illustrated in FIG. 3, the foldable insulated bag 1 has the fold back portion 41 provided to cover an end portion 34 of the bottom surface insulating member 26. Thus, the cold air can be prevented from leaking between the bottom surface insulating member and the side surface insulating member, whereby the cooling effect can be improved.

The length of the fold back portion 41 may be 5 mm to 170 mm. I found that the leakage of the cold air in the insulated bag and a thermal effect from the ground can be suppressed with such a configuration. A test has revealed that the percentage of ice remaining after a predetermined period of time has increased by 7% or more.

With the fold back portion 41 having a length within such a range, when the insulated bag 1 is folded, the size after the folding based on the size of the box can be downsized. Thus, the insulated bag can be easily folded, and can have a reduced thickness in a folded state.

The fold back portion 41 may be configured to be formed over the entire circumference of the side surface insulating member 28. Thus, the cold air can be prevented from leaking between the bottom surface insulating member and the side surface insulating member, whereby the cooling effect can be further improved.

Figure 4A:
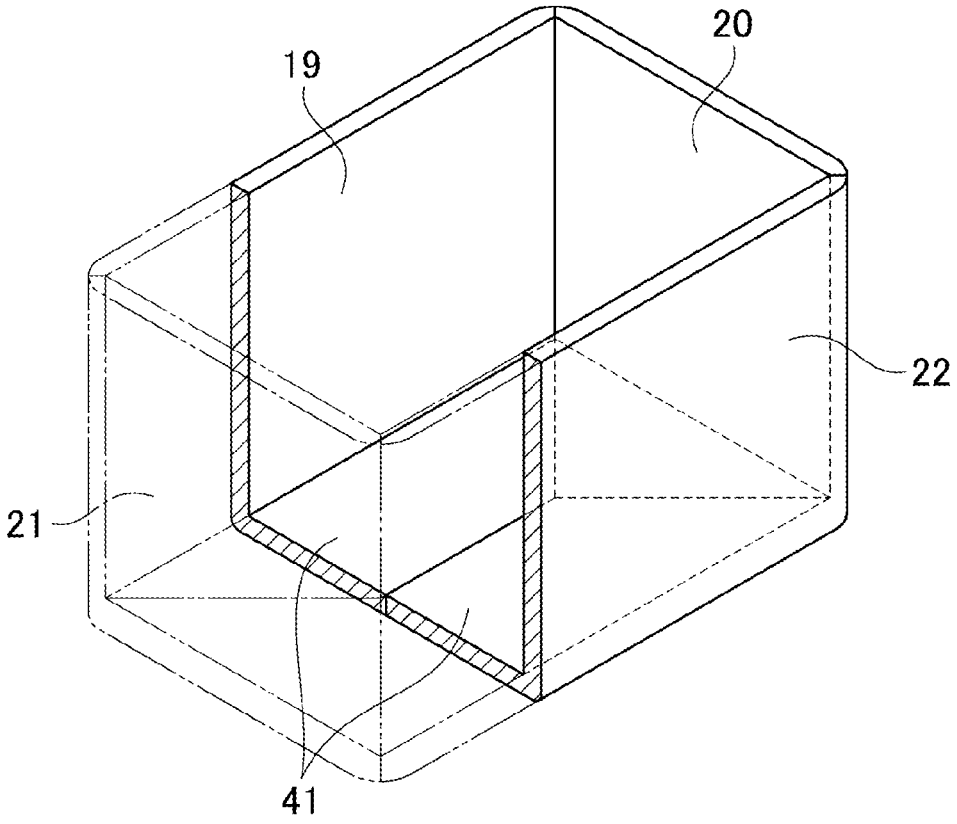
FIG. 4*a* is a diagram illustrating an insulating member of the foldable insulated bag according to an example.
Figure 4B:
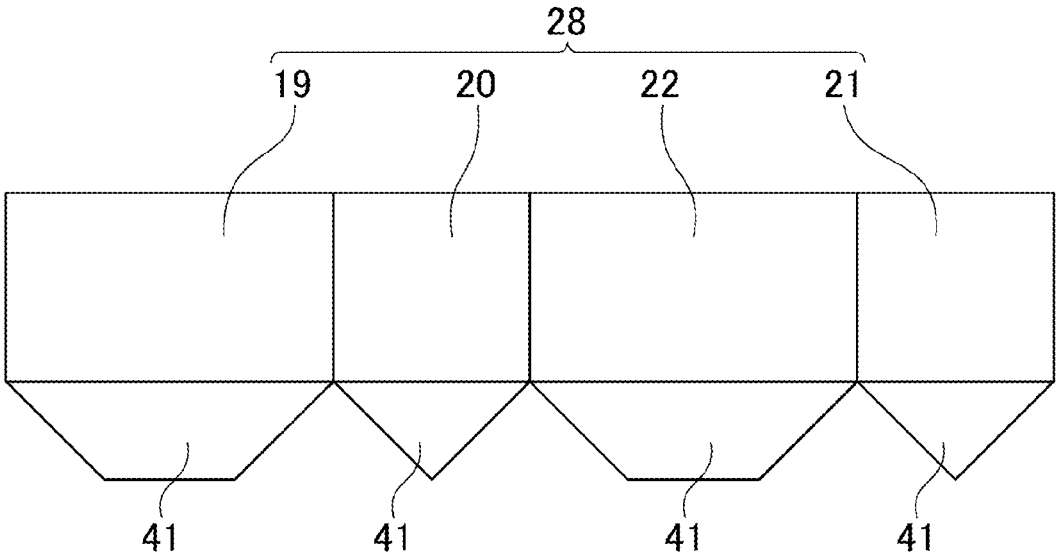
FIG. 4*b* is a diagram illustrating the insulating member of the foldable insulated bag according to an example.

Next, the foldable insulated bag 1 will be described with reference to FIGS. 4*a* and 4*b*. As illustrated in FIGS. 4*a* and 4*b*, in the foldable insulted bag 1 according to an example, the fold back portion 41 is notched at boundary regions among a first side surface insulating member 19, a second side surface insulating member 20, and a third side surface insulating member 21 of the side surface insulating member 28 adjacent to each other, for example. As illustrated FIGS. 4*a* and 4*b*, the notching is similarly implemented for the other side surface insulating member. Thus, the fold back portions can be prevented from overlapping, whereby the cold air can be more effectively prevented from leaking between the bottom surface insulating member and the side surface insulating member, whereby the cooling effect can further be improved.

The fold back portion 41 may cover the bottom surface insulating member 26. Thus, the leakage of the cold air in the insulated bag and a thermal effect from the ground can be more effectively suppressed.

The fold back portion 41 may cover 5% to 100% of the surface area of the bottom surface insulating member 26. Thus, the leakage of the cold air in the insulated bag and a thermal effect from the ground can be suppressed.

Figure 5:
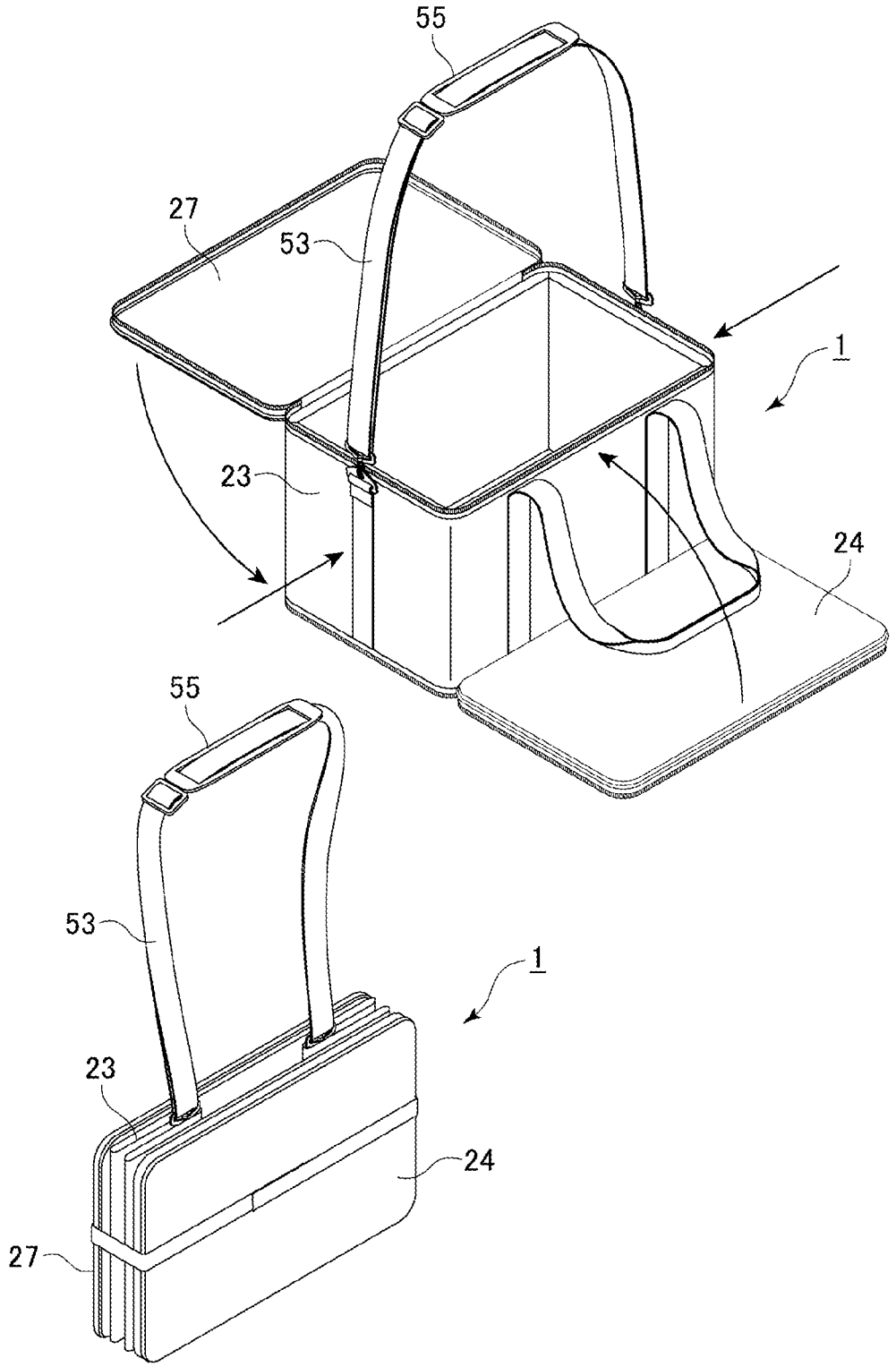
FIG. 5 is a diagram illustrating folding of the foldable insulated bag according to an example.

FIG. 5 illustrates the foldable insulated bag 1 according to an example in a folded state. As illustrated in the figure, opening is implemented by pulling the respective fasteners 29 on the lid body 27 and the bottom surface portion 24. Then, the lid body 27 and the bottom surface portion 24 are pivoted by 270 degrees in directions opposite to each other to have their surfaces overlapped with and brought into contact with the outer surfaces of the facing side surfaces. Then, the side surface portions 49 and 51 are bent with their center part recessed to be in a V shape. The resultant form is maintained using a belt with hook-and-loop fastener (not illustrated) on the inner side of the bottom surface portion 24. With the shoulder belt 53 taken out in this process, the resultant object can be carried on the shoulder. I found that, with the lid body 27 and the bottom surface portion 24 thus designed to be opened toward the opposite directions, they can be pivoted to be in contact with the respective facing side surface so that the folding can be performed easily and can result in a more compact form.

As described above, when the insulated bag 1 is folded, the fold back portion 41 can be substantially parallel to the side surface insulating member 28 so that the insulated bag folded would not have the thickness unnecessarily increased.

Thus, the fold back portion is provided so that the insulated bag can be easily folded, and the leakage of the cold air between the insulating members for the respective surfaces can be reliably reduced so that the cooling effect can be reliably improved.

Figure 6:
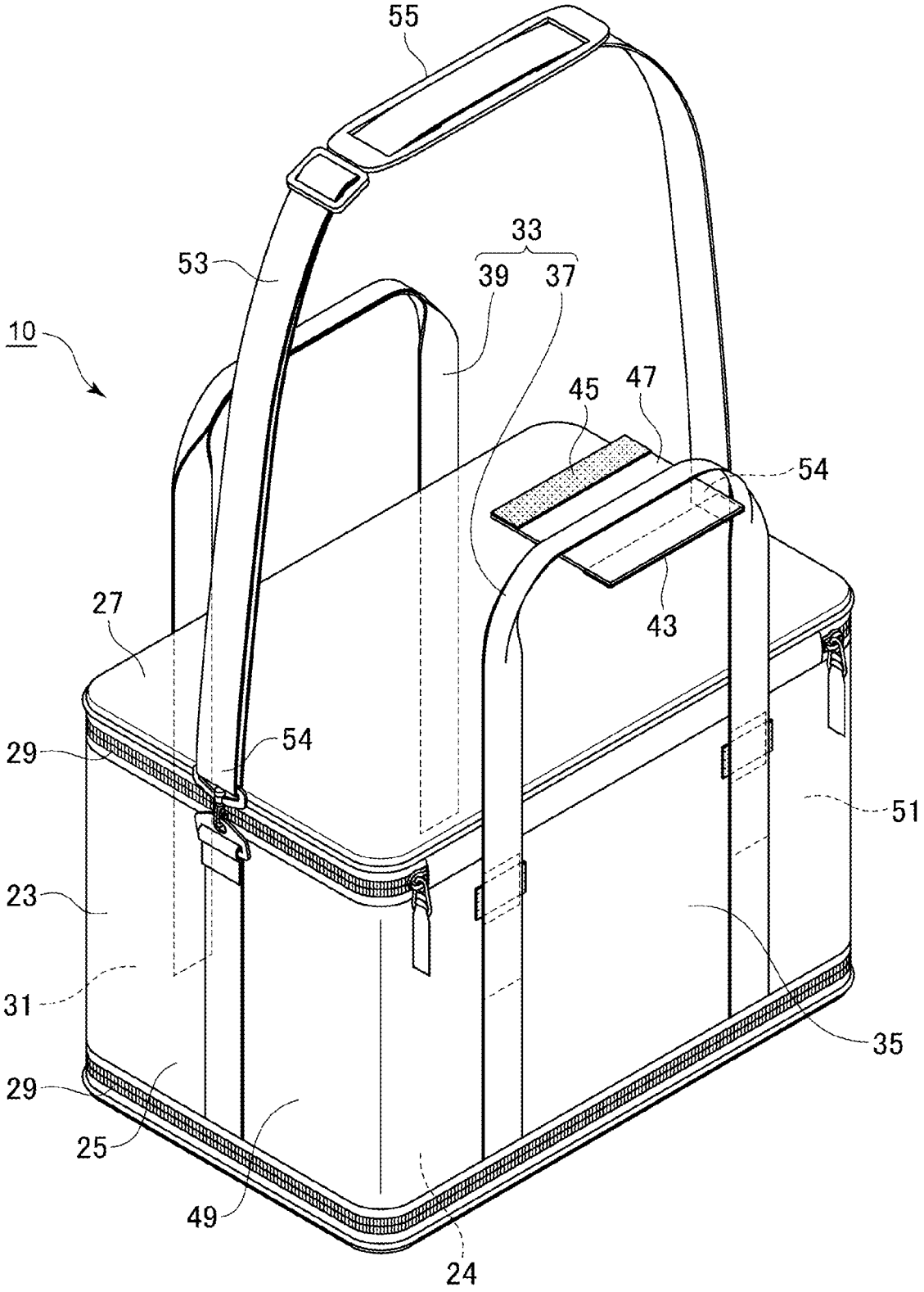
FIG. 6 is a diagram illustrating an insulated bag according to an example.
Figure 7:
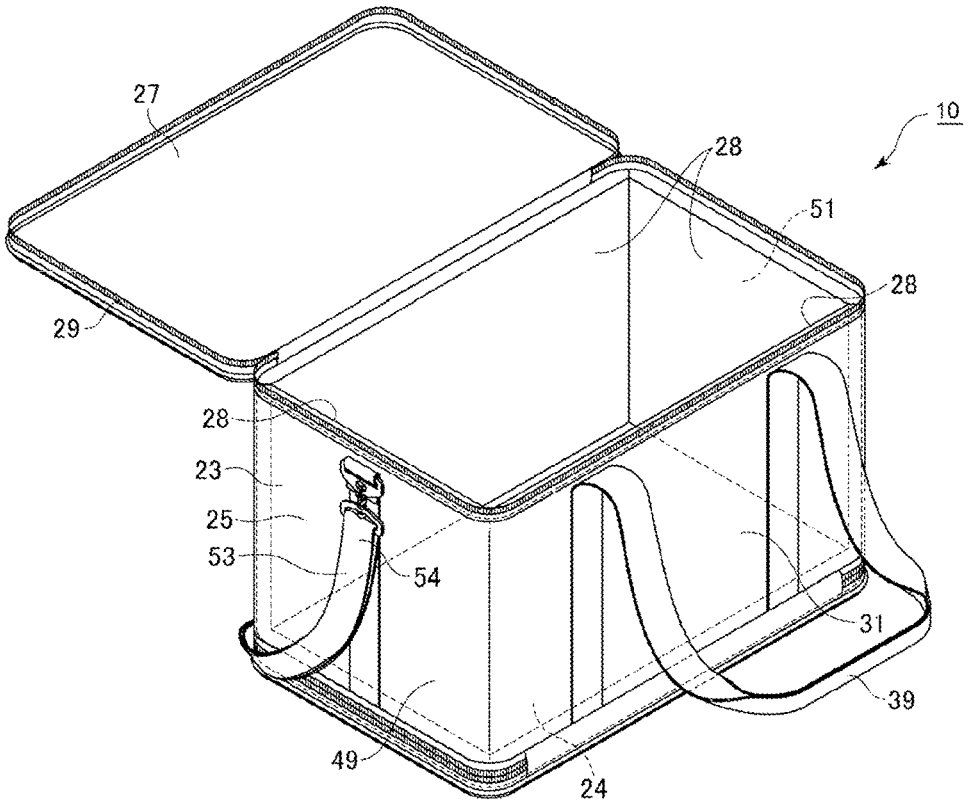
FIG. 7 is a diagram illustrating an insulated bag according to an example.

An example of my insulated bag is described with reference to FIGS. 6 and 7. As illustrated in the figures, the insulated bag 10 includes a waterproof bag main body 23 having a waterproof cloth (obtained by coating a nylon or polyester woven cloth with PVC/PU/EVA) provided on the outer side, a nylon or polyester cloth provided on the inner side, and a synthetic resin foaming material such as PE or Styrofoam provided in between (the waterproof cloth surface may alternatively be used on a reverse side). The foldable insulated bag is formed to be in a shape of a box having a bottom surface and side surfaces, with an internal portion serving as a storage portion, and with a storage port opened in an upper portion. As described later, insulating members accommodating heat insulating materials are provided for respective inner surfaces of the bag main body 23 to be side surface insulating members and a bottom surface insulating member. Attachment of the heat insulating members to the respective surface of the bag main body 23 may be implemented in various possible ways, and thus is not limited to a particular mode.

The lid body 27 formed of the same material as the bag main body 23 is coupled to one side (a rear surface side surface 35 described later) via a hinge member (not illustrated) made of a synthetic resin sheet (for example, nylon, polyester woven cloth or the like). The lid body 27 has a circumference edge portion provided with a fastener portion 29 that surrounds an upper portion outer circumference of the bag main body 23 when the storage port is covered by the lid body 27 (when the storage port is closed by the lid body 27). The fastener portion 29 extends along the outer circumference. The inner surface of the lid body 27 is provided with the insulating member accommodating the heat insulating material as an upper surface insulating member. The attachment of the heat insulating member to the lid body 27 may be implemented in various possible ways, and thus is not limited to a particular mode.

The insulated bag 10 may include a handle 33 including a pair of both end portions attached to the bag main body 23. The handle 33 is attached to upper portion outer circumferences of a front surface side surface 31 and the rear surface side surface 35 of the bag main body 23 as illustrated in FIGS. 6 and 7, for example. However, this should not be construed in a limiting sense. In the illustrated example, the handle 33 includes a pair of U shaped handles 37 and 39. For example, center portions of the U-shaped handles 37 and 39 as the handle 33 may be capable of being bundled by a handle bundling loop-shaped grip 47 on which hook-and-loop fasteners 43 and 45 are sewed, to be held by a hand of a person carrying the insulated bag 10.

The insulated bag 10 may further include a shoulder belt 53 both end portions of which are attached to the bag main body 23. In this configuration, the shoulder belt 53 may be formed as a single thin belt-shaped shoulder belt 53 that is made of woven cloth or synthetic resin (molded product), fabric, leather, or the like and is spun between left and right side surfaces 49 and 51 of the bag main body 23 as illustrated in FIGS. 6 and 7. Both end portions 54 of the shoulder belt 53 may be sewed and fixed to the left and right side surfaces 49 and 51.

The shoulder belt 53 of the insulated bag 10 has a length long enough for the center portion in the longitudinal direction to touch the ground, when the shoulder belt 53 hangs down from the insulated bag 10 placed on the ground. A plate-shaped shoulder pad 55 having a dimension (length L) that is substantially ⅓ of the entire length of the shoulder belt 53 is attached to the center portion of the shoulder belt 53. Further details will be omitted.

Figure 8:
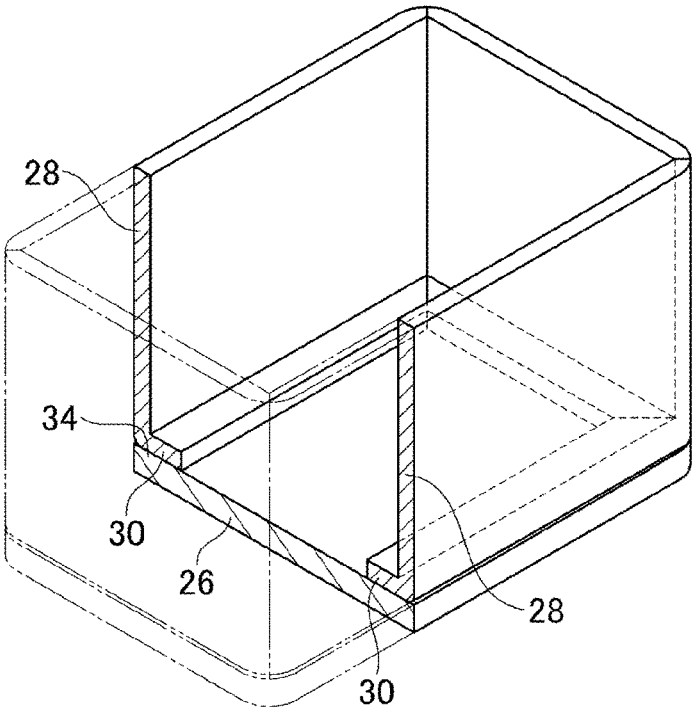
FIG. 8 is a diagram illustrating the insulating member of the insulated bag according to an example.
Figure 9:
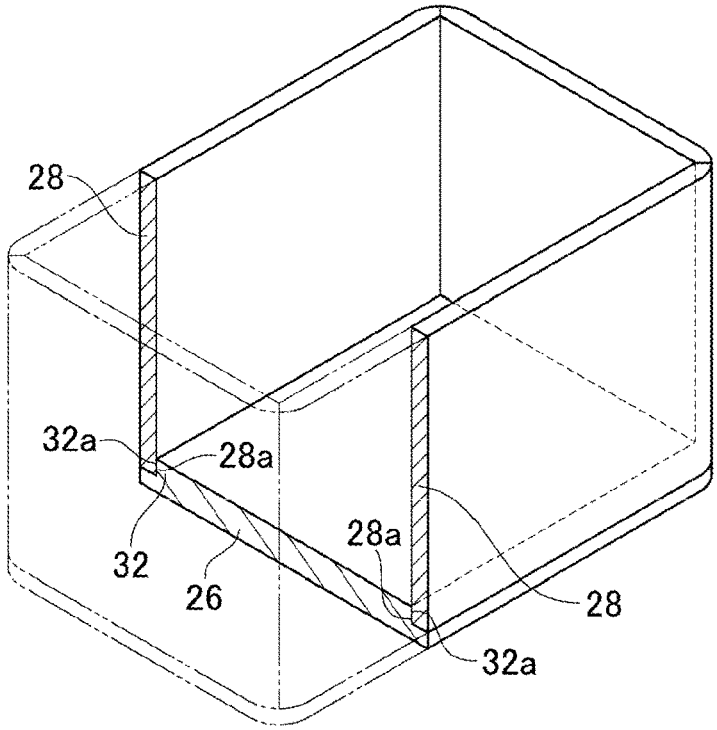
FIG. 9 is a diagram illustrating the insulating member of the insulated bag according to an example.
Figure 11:
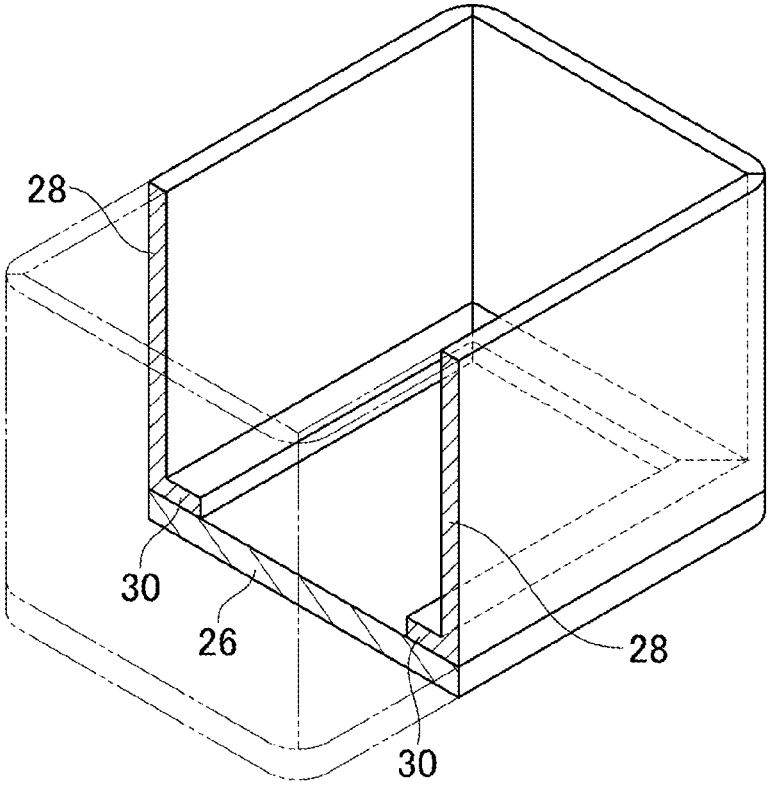
FIG. 11 is a diagram illustrating the insulating member of the insulated bag according to an example.

Next, an insulated bag 10 according to an example will be described more in detail with reference to FIGS. 8, 9, and 11. As illustrated in FIGS. 8, 9, and 11, the insulated bag 10 includes: the bag main body 23 including a bottom surface portion 24 and side surface portions 25; the lid body 27 attached to the bag main body 23; and the bottom surface insulating member 26 and the side surface insulating member 28 provided to the bag main body 23. The insulated bag 10 further includes, to increase the contact area between the side surface insulating member 28 and the bottom surface insulating member 26 during the use of the insulated bag, one or both of an extending portion 30 extending in a vertical direction from the side surface insulating member 28 and a step portion 32 formed in the bottom surface insulating member 26. In the example illustrated in FIG. 8, the extending portion 30 is formed integrally with the side surface insulating member 28 to be in a substantially plate shape. The extending portion 30 comes into contact with the bottom surface insulating member 26 upon being appropriately bent. On the other hand, in the example illustrated in FIG. 11, the extending portion 30 is integrally molded with the side surface insulating member 28.

The bottom surface insulating member and the side surface insulating member do not need to be integrally formed, whereby insulating members for respective surfaces can be formed more easily and at a lower cost, and leakage of cold air between the insulating members for the respective surfaces can be reliably reduced so that the cooling effect can be improved.

It has been known that the cooling effect of the insulated bag depends on two factors: a thermal effect from the ground on which the insulated bag is placed; and leakage of the cold air from the internal of the insulated bag (leakage of the cold air from a portion around the bottom portion in particular). To reduce the impact of the former factor, the bottom portion insulating member may be made thick, but this approach is limited by restrictions in terms of weight and dimensions. On the other hand, regarding the latter, I found that effective prevention of the leakage of the cold air between the bottom surface insulating member and the side surface insulating member individually formed is important, and I found a specific measure to achieve this. The side surface insulating member 28 may be formed by forming a single plate-shaped insulating member, bending the insulating member, and appropriately coupling/bonding both end portions of the insulating member.

As illustrated in FIG. 8, the insulated bag 10 has the extending portion 30 provided to cover an end portion 34 of the bottom surface insulating member 26. Thus, the cold air can be prevented from leaking between the bottom surface insulating member and the side surface insulating member, whereby the cooling effect can be improved The length of the extending portion 30 may be 5 mm to 170 mm. I found that the leakage of the cold air in the insulated bag and a thermal effect from the ground can be suppressed with this configuration.

In the insulated bag 10, the extending portion 30 may be configured to be formed over the entire circumference of the side surface insulating member 28. Thus, the cold air can be prevented from leaking between the bottom surface insulating member and the side surface insulating member, whereby the cooling effect can be improved.

Figure 10A:
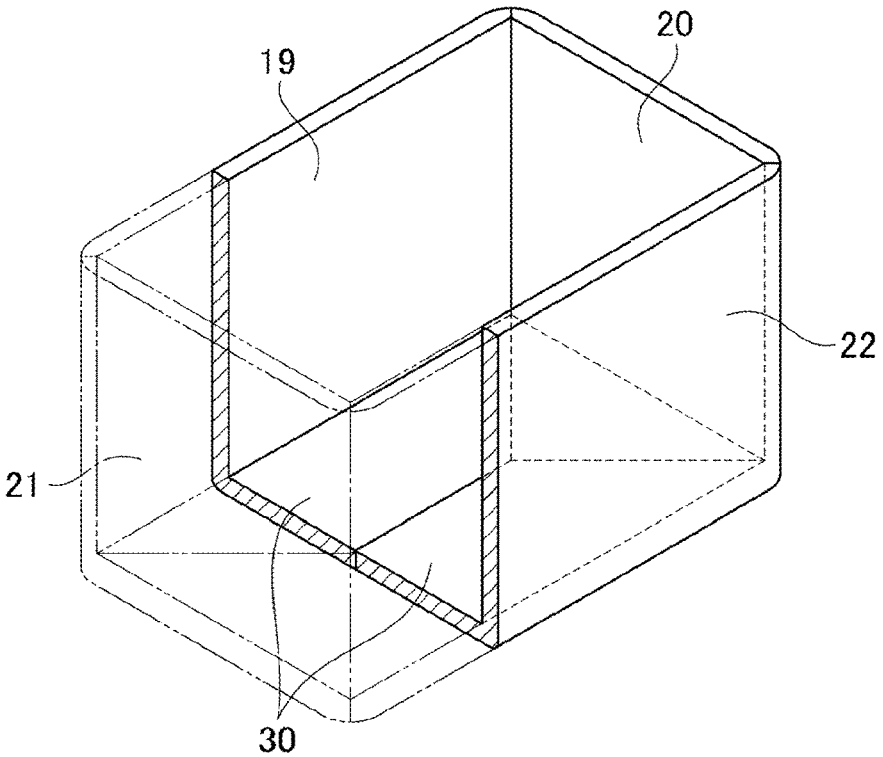
FIG. 10*a* is a diagram illustrating the insulating member of the insulated bag according to an example.
Figure 10B:
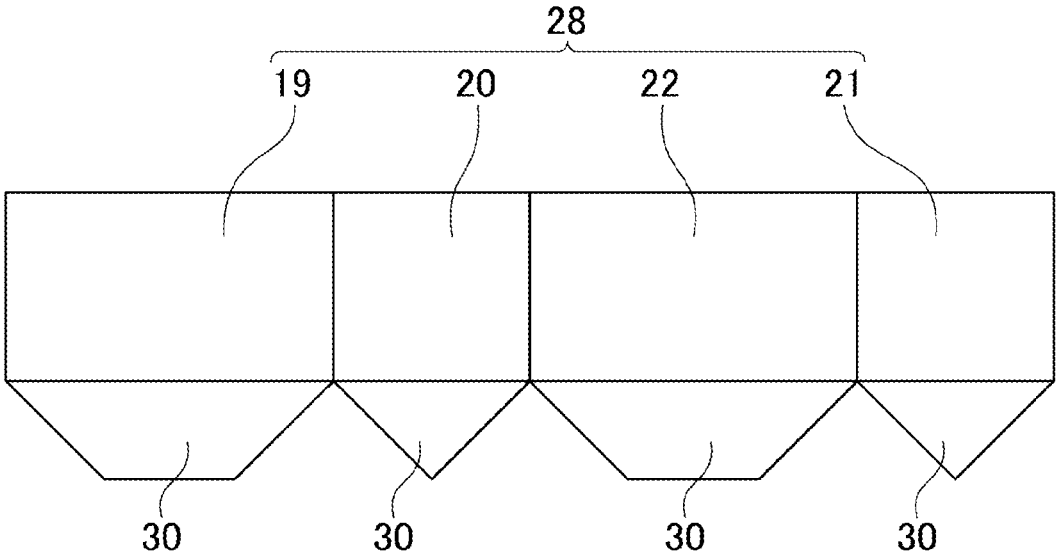
FIG. 10*b* is a diagram illustrating the insulating member of the insulated bag according to an example.

Next, the insulated bag 10 according to an example will be described with reference to FIGS. 10*a* and 10*b*. As illustrated in FIGS. 10*a* and 10*b*, in the insulated bag 10, the extending portion 30 is notched at boundary regions among a first side surface insulating member 19, a second side surface insulating member 20, and a third side surface insulating member 21 of the side surface insulating member 28 adjacent to each other, for example. As illustrated FIGS. 10*a* and 10*b*, the notching is similarly implemented for the other side surface insulating member. Thus, the fold back portions can be prevented from overlapping, whereby the cold air can be more effectively prevented from leaking between the bottom surface insulating member and the side surface insulating member, whereby the cooling effect can further be improved.

The extending portion 30 may be provided to cover the bottom surface insulating member 26. Thus, the leakage of the cold air in the insulated bag and a thermal effect from the ground can be more effectively suppressed.

The extending portion 30 may cover 5% to 100% of the surface area of the bottom surface insulating member 26. Thus, the leakage of the cold air in the insulated bag and a thermal effect from the ground can be suppressed.

Figure 12:
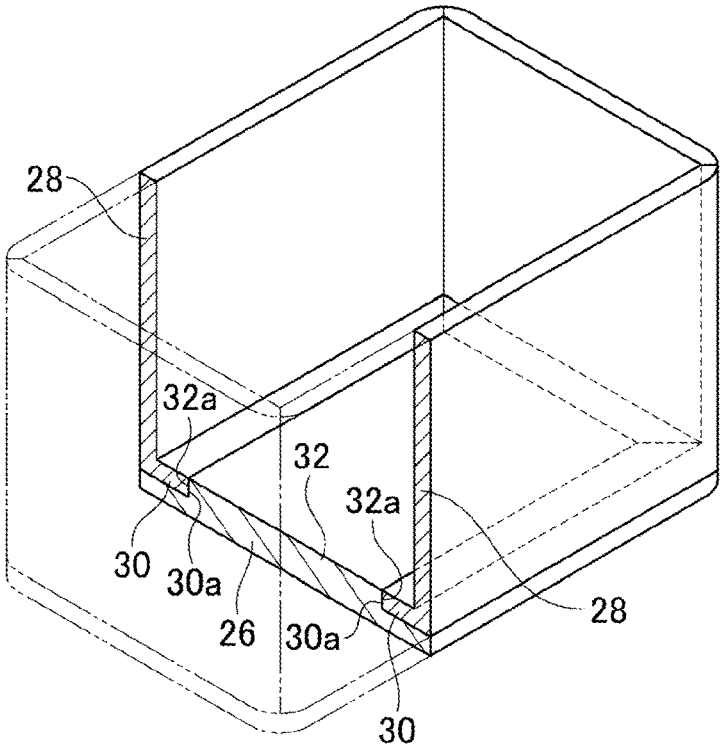
FIG. 12 is a diagram illustrating the insulating member of the insulated bag according to an example.

Next, the insulating member of the insulated bag 10 according to an example will be described with reference to FIG. 12. FIG. 12 illustrates an example of where the extending portion 30 and the step portion 32 are provided in the insulated bag 10. The step portion 32 is provided to have a side portion 32*a* brought into contact with a side portion 30*a* of the extending portion 30. With this configuration, the contact area can be largely increased, whereby the leakage of the cold air in the insulated bag and thermal effect from the ground can be suppressed.

Figure 13:
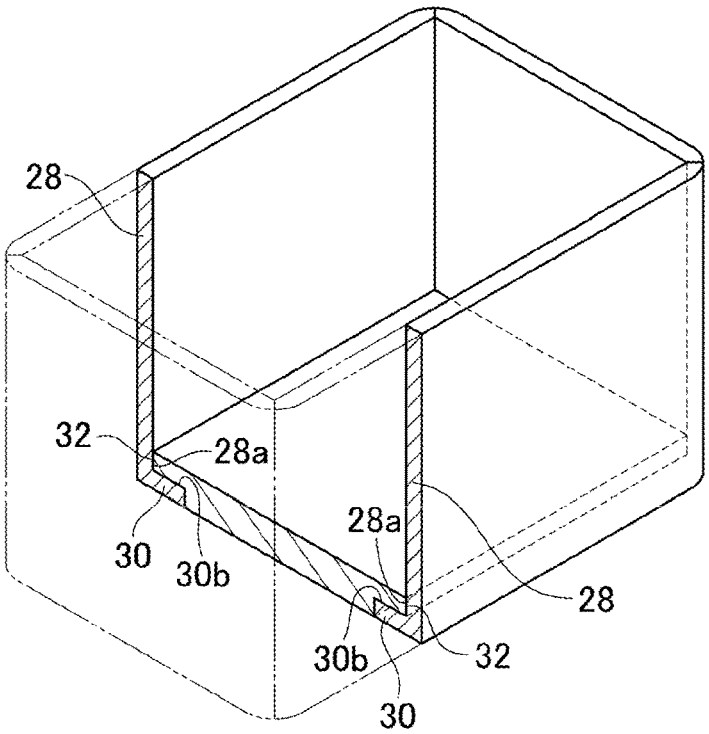
FIG. 13 is a diagram illustrating the insulating member of the insulated bag according to an example.

Next, the insulating member of the insulated bag 10 according to an example will be described with reference to FIG. 13. FIG. 13 also illustrates an example of where the insulated bag 10 is provided with the extending portion 30 and the step portion 32. The step portion 32 (which can be also referred to as a reversed step portion or a protrusion portion, but is referred to as the step portion 32 herein) is provided to be in contact with an upper portion 30*b* of the extending portion 30 and the side portion 28*a* of the side surface insulating member 28. With this configuration, the contact area can be largely increased, whereby the leakage of the cold air in the insulated bag and thermal effect from the ground can be suppressed. When an article is put in the bag, the weight of the article can contribute to the prevention of the leakage of the cold air inside.

Next, the insulating member of the insulated bag 10 according to an example will be described by referring back to FIG. 9. FIG. 9 illustrates an example of where the step portion 32 is provided in the insulated bag 10 according to an example. The step portion 32 is provided to have a side surface 32*a* brought into contact with a side portion 28*a* of the side surface portion insulating member 28. With this configuration, the contact area can be largely increased, whereby the leakage of the cold air in the insulated bag and thermal effect from the ground can be suppressed.

The dimensions, material, and arrangement of each component described herein are not limited to those explicitly described in the examples, and each of these components can be modified to have any desirable dimensions, material, and arrangement that can fall within the scope of this disclosure. Components that are not explicitly described herein may be added to the described examples, and some of the components described in each example may be omitted.

What is claimed is:

1. A foldable insulated bag comprising:

a bag main body including a bottom surface portion and a side surface portion;

a lid body attached to the bag main body; and a bottom surface insulating member and a side surface insulating member provided to the bottom surface portion and the side surface portion of the bag main body, respectively, wherein the side surface insulating member has an end portion, closer to the bottom surface insulating member, provided with a fold back portion provided to cover at least a part of the bottom surface insulating member during use of the insulated bag, wherein the fold back portion comprises an inner surface facing inside of the bag main body and an outer surface facing outside of the bag main body, and wherein a shortest distance between the part of the bottom surface insulating member covered by the fold back portion and the outer surface of the fold back portion is less than a shortest distance between the part of the bottom surface insulating member covered by the fold back portion and the inner surface of the fold back portion, wherein the fold back portion extends from entire circumference of the side surface insulating member wherein the bottom surface portion of the bag main body is separate and removable from the bottom surface insulating member, wherein the side surface portion of the bag main body is separate and removable from the side surface insulating member.

2. The insulated bag according to claim 1, wherein the fold back portion is provided to cover an end portion of the bottom surface insulating member.

3. The insulated bag according to claim 1, wherein the fold back portion has a length of 5 mm to 170 mm.

4. The insulated bag according to claim 1, wherein the fold back portion is notched at boundary regions among a first side surface insulating member, a second side surface insulating member, and a third side surface insulating member adjacent to each other.

5. The insulated bag according to claim 1, wherein the fold back portion covers 5% to 100% of a surface area of the bottom surface insulating member.

6. The insulated bag according to claim 1, wherein the fold back portion covers the bottom surface insulating member.

7. An insulated bag comprising:

a bag main body including a bottom surface portion and a side surface portion;

a lid body attached to the bag main body;

a bottom surface insulating member and a side surface insulating member provided to the bottom surface portion and the side surface portion of the bag main body, respectively; and an extending portion extending from an end of the side surface insulating member for increasing a contact area between the side surface insulating member and the bottom surface insulating member during use of the insulated bag, wherein the side surface insulating member extends in a first direction and the extending portion extends from the end of the side surface insulating member in a second direction, which is orthogonal to the first direction, wherein the extending portion extends from entire circumference of the side surface insulating member, wherein the bottom surface portion of the bag main body is separate and removable from the bottom surface insulating member, wherein the side surface portion of the bag main body is separate and removable from the side surface insulating member.

8. The insulated bag according to claim 7, wherein the extending portion covers an end portion of the bottom surface insulating member.

9. The insulated bag according to claim 7, wherein the extending portion has a length of 5 mm to 170 mm.

10. The insulated bag according to claim 7, wherein the extending portion is notched at boundary regions among a first side surface insulating member, a second side surface insulating member, and a third side surface insulating member adjacent to each other.

11. The insulated bag according to claim 7, wherein the extending portion covers 5% to 100% of a surface area of the bottom surface insulating member.

12. The insulated bag according to claim 7, wherein the extending portion covers the bottom surface insulating member.

13. The insulated bag according to claim 7, further comprising a step portion formed in the bottom surface insulating member, wherein the step portion has a side surface in contact with a side portion of the extending portion.

14. The insulated bag according to claim 7, further comprising a step portion formed in the bottom surface insulating member, wherein the step portion is in contact with an upper portion of the extending portion and a side portion of the side surface insulating member.

15. The insulated bag according to claim 7, further comprising a step portion formed in the bottom surface insulating member, wherein the step portion has a side surface in contact with a side portion of the side surface portion insulating member.

16. The insulated bag according to claim 7, further comprising a step portion formed in the bottom surface insulating member.

* * * * *